US012458199B2

(12) United States Patent
Kremmel et al.

(10) Patent No.: US 12,458,199 B2
(45) Date of Patent: Nov. 4, 2025

(54) DISHWASHING APPLIANCE HAVING AN INTEGRATED LEVEL

(71) Applicant: Haier US Appliance Solutions, Inc., Wilmington, DE (US)

(72) Inventors: Aldo Vincent Kremmel, Palmyra, IN (US); Logan Chayse Dunaway, Greenville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 187 days.

(21) Appl. No.: 18/476,873

(22) Filed: Sep. 28, 2023

(65) Prior Publication Data

US 2025/0107685 A1 Apr. 3, 2025

(51) Int. Cl.
*A47L 15/42* (2006.01)
*A47L 15/00* (2006.01)

(52) U.S. Cl.
CPC ..... *A47L 15/4259* (2013.01); *A47L 15/0028* (2013.01)

(58) Field of Classification Search
None
See application file for complete search history.

(56) References Cited

U.S. PATENT DOCUMENTS 6,654,975 B2 12/2003 Broker
11,116,381 B2 9/2021 Strahle

FOREIGN PATENT DOCUMENTS

CN 2294982 Y 10/1998
EP 3788198 A1 3/2021
WO WO2019007635 A1 1/2019

OTHER PUBLICATIONS

"1Pc Bubble Level Measuring Tools Round Bubble Spirit Levels Circular Bullseye Bubble Degree Marked Surface Leveling for Camera Tripod Frame Furniture Measuring Instruments Layout Tools 60×12mm", Sikeewii, https://www.amazon.in/Measuring-Circular-Bullseye-Furniture-Instruments/dp/B07VT4P7TT, accessed on Sep. 28, 2023, 5 pages.

*Primary Examiner* — Rita P Adhlakha
(74) *Attorney, Agent, or Firm* — Dority & Manning, P.A.

(57) ABSTRACT

An appliance includes a tub that defines a chamber having an opening and a door secured to the tub adjacent to the opening. The door is moveable between an open position and a closed position for providing selective access to the chamber. The appliance also includes a component secured within the chamber and a bubble level integrated with the component. Thus, the bubble level is viewable from outside of the chamber when the door is in the open position.

20 Claims, 8 Drawing Sheets

DISHWASHING APPLIANCE HAVING AN INTEGRATED LEVEL

FIELD

The present disclosure relates generally to dishwashing appliances, and more particularly, to a dishwashing appliance having an integrated level.

BACKGROUND

Dishwashing appliances generally include a tub that defines a wash chamber. Rack assemblies can be mounted within the wash chamber of the tub for receipt of articles for washing. Multiple spray assemblies can be positioned within the wash chamber for applying or directing wash liquid (e.g., water, detergent, etc.) towards articles disposed within the rack assemblies in order to clean such articles. Dishwashing appliances are also typically equipped with one or more pumps, such as a circulation pump or a drain pump, for directing or motivating wash liquid from the sump to, e.g., the spray assemblies or an area outside of the dishwashing appliance.

Dishwashing appliances also include a door for providing selective access to the wash chamber. In order to provide a user with information regarding the dishwashing appliance operation, e.g., such as a status of an operating cycle or an indication that a cycle is complete, status indicators are often positioned on the outer door of the appliance such that they are visible to a user of the appliance. Additionally, in order to provide a user with an interface to set or adjust the operational settings for the dishwashing appliance, a user interface panel is often positioned on the top of the door of the dishwashing appliance. Many dishwashing appliances are also equipped with one or more filters for filtering the water and catching food particles as the appliance runs a wash cycle. Oftentimes, the filter is located below the lower dish rack in the bottom of the dishwashing appliance.

When a dishwashing appliance is installed, it is important to confirm the unit is level in place. If the unit is not level, several failure modes can occur, some of which have serious consequences that can ultimately lead to warranty claims, repairs, etc. Currently, the industry relies on the installer, whether it be a third party or the user, to perform the installation properly and verify the unit is level. Thus, the installer/user is given installation instructions for installing the dishwashing appliance in a level manner. Oftentimes, however, the installer overlooks the task of ensuring the dishwashing appliance is level, a level is not available, and/or the installer does not level the unit from front to back and from left to right. Further, certain instructions require the installer to have a level of a particular length to ride front to back along the dishwashing appliance and left to right along the door when open, which is subject to variation.

Accordingly, the present disclosure is directed to a dishwashing appliance having an integrated level that addresses the aforementioned issues.

BRIEF DESCRIPTION

Aspects and advantages of the invention will be set forth in part in the following description, or may be obvious from the description, or may be learned through practice of the invention.

In an aspect, the present disclosure is directed to an appliance having a tub that defines a chamber having an opening. The appliance includes a door secured to the tub adjacent to the opening. The door is moveable between an open position and a closed position for providing selective access to the chamber. The appliance also includes a component secured within the chamber and a bubble level integrated with the component. Thus, the bubble level is viewable from outside of the chamber when the door is in the open position.

In another aspect, the present disclosure is directed to a dishwashing appliance. The dishwashing appliance includes a tub that defines a wash chamber having a front opening and a door secured to the tub adjacent to the front opening. The door is moveable between an open position and a closed position for providing selective access to the wash chamber. Further, the dishwashing appliance includes a filter secured within the chamber. The filter has a recess formed into an exterior surface thereof. Moreover, the dishwashing appliance includes a bubble level positioned in the recess of the filter. Thus, the bubble level is viewable from outside of the chamber when the door is in the open position.

In yet another aspect, the present disclosure is directed to a method of manufacturing an appliance having a tub that defines a chamber having an opening. The method includes forming a component of the appliance having a recess formed into an exterior surface thereof, securing a bubble level within the recess of the component, securing the component within the chamber, and securing a door to the tub adjacent to the opening, the door moveable between an open position and a closed position for providing selective access to the chamber. As such, the bubble level is viewable from outside of the chamber when the door is in the open position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
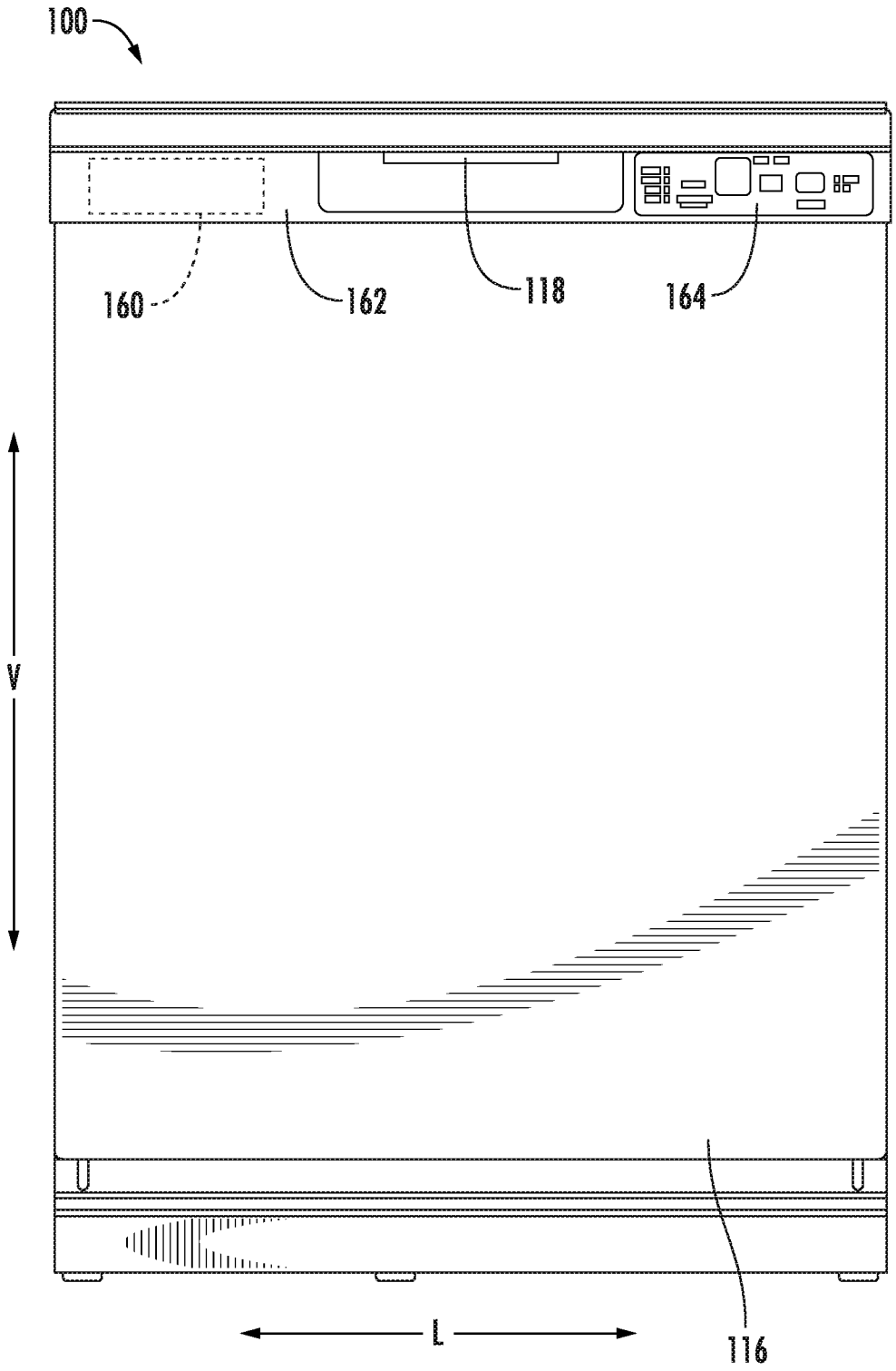
FIG. 1 provides a front view of a dishwashing appliance according to one or more exemplary embodiments of the present disclosure.

Repeat use of reference characters in the present specification and drawings are intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is used to refer to an overall operation of the dishwashing appliance which may include two or more distinct phases. The term "wash phase" is intended to refer to one or more periods of time during which a dishwashing appliance operates while containing the articles to be washed and uses a wash liquid (e.g., water, detergent, or wash additive) and may be a portion of the wash cycle, such as a beginning or early portion of the wash cycle. The term "rinse phase" is intended to refer to one or more periods of time during which the dishwashing appliance operates to remove residual soil, detergents, and other undesirable elements that were retained by the articles after completion of the wash phase and may be a portion of the wash cycle, such as an intermediate portion of the wash cycle. The term "drain phase" is intended to refer to one or more periods of time during which the dishwashing appliance operates to discharge soiled water from the dishwashing appliance and may be a portion of the wash cycle, such as a later portion of the wash cycle. The term "wash liquid" refers to a liquid used for washing or rinsing the articles that is typically made up of water and may include additives, such as detergent or other treatments (e.g., rinse aid).

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
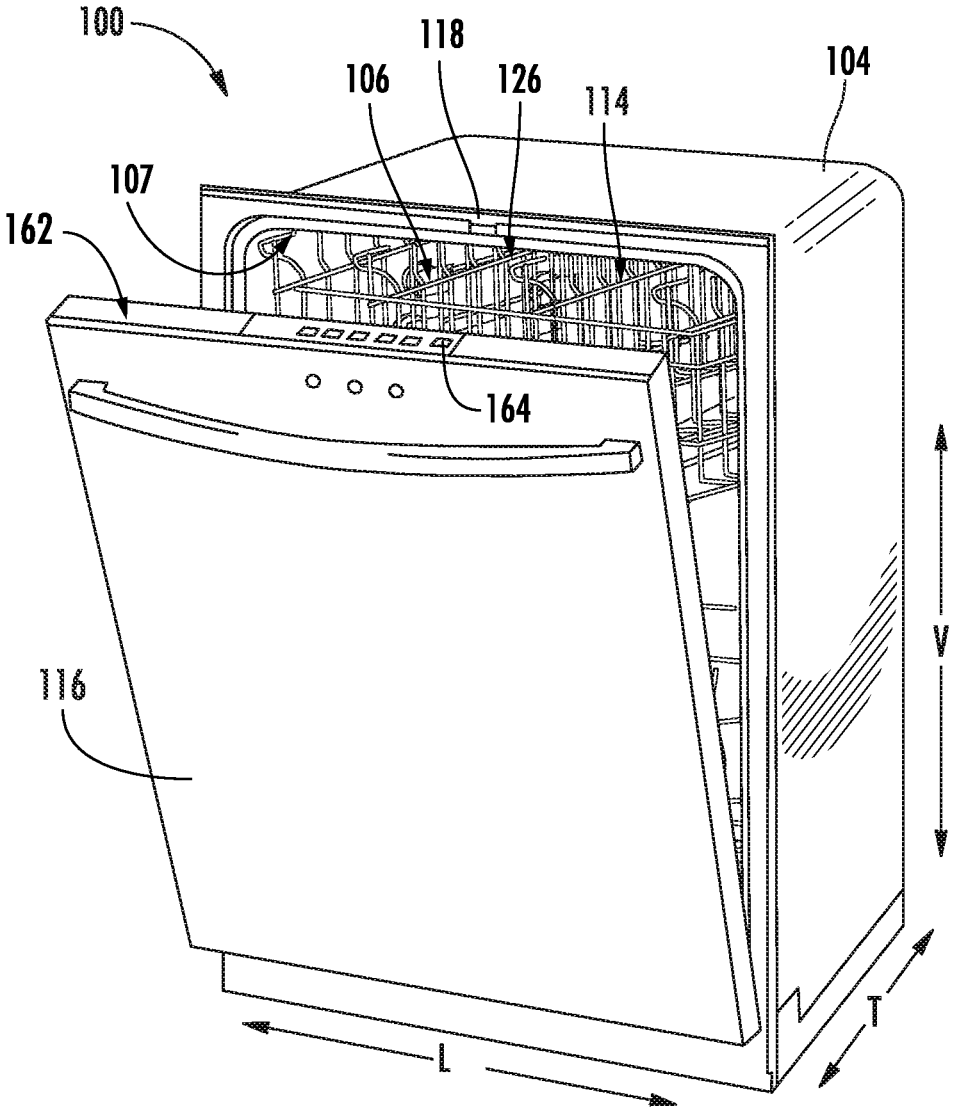
FIG. 2 provides a perspective view of a dishwashing appliance with a door in an intermediate position according to one or more exemplary embodiments of the present disclosure.
Figure 3:
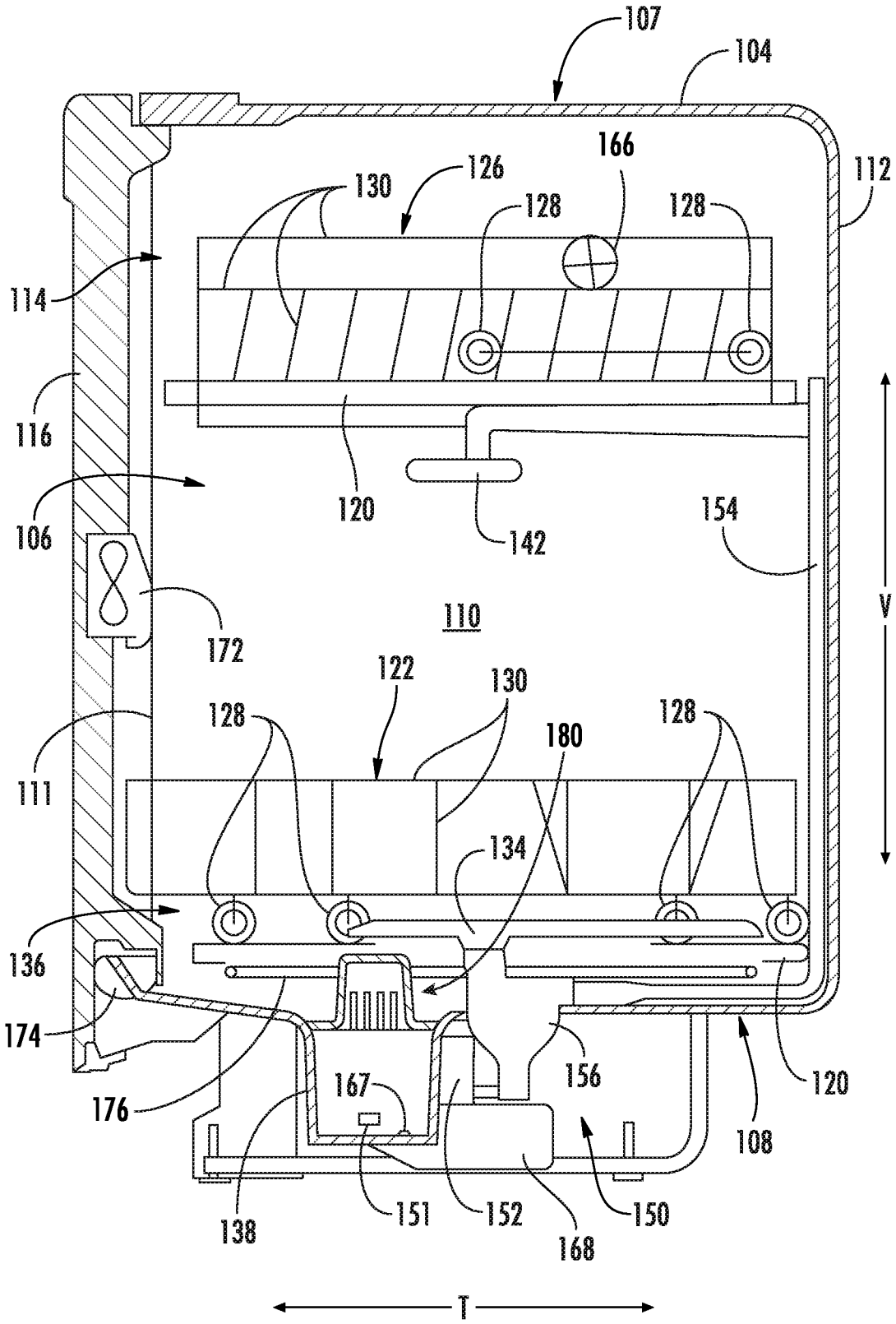
FIG. 3 provides a side, cross section view of a dishwashing appliance, such as the dishwashing appliance of FIG. 1 or FIG. 2, according to one or more exemplary embodiments of the present disclosure.

Referring now to the figures, FIGS. 1 through 3 depict a dishwashing appliance 100 that may be configured according to one or more exemplary aspects of the present disclosure. Generally, the dishwashing appliance 100 defines a vertical direction V, a lateral direction L, and a transverse direction T. Each of the vertical direction V, lateral direction L, and transverse direction T are mutually perpendicular to one another and form an orthogonal direction system. The dishwashing appliance 100 may include a tub 104 that defines a wash chamber 106 therein. As shown in FIG. 3, the tub 104 extends between a top 107 and a bottom 108 along the vertical direction V, between a pair of side walls 110 along the lateral direction L, and between a front side 111 and a rear side 112 along the transverse direction T.

In some embodiments, the tub 104 includes a front opening 114 at the front side 111. Additionally, in some embodiments, the dishwashing appliance 100 includes a door 116 at the front opening 114. The door 116 may, for example, be coupled to the tub 104 by a hinge 174 (FIGS. 3 and 4) at its bottom for movement between a normally closed vertical position (FIGS. 1 and 3), wherein the wash chamber 106 is sealed shut for washing operation, and an open position for loading and unloading of articles from the dishwashing appliance 100. A door closure mechanism or assembly 118, e.g., a latch, may be provided to lock and unlock the door 116 for accessing and sealing the wash chamber 106.

In an embodiment, the tub side walls 110 accommodate a plurality of rack assemblies. For instance, guide rails 120 may be mounted to the side walls 110 for supporting a lower rack assembly 122 and an upper rack assembly 126. In some such embodiments, the upper rack assembly 126 is positioned at a top portion of the wash chamber 106 above the lower rack assembly 122 along the vertical direction V.

Generally, each rack assembly 122, 126 may be adapted for movement between an extended loading position (not shown) in which the rack is substantially positioned outside the wash chamber 106, and a retracted position (FIG. 3) in which the rack is located inside the wash chamber 106. In some embodiments, movement is facilitated, for instance, by rollers 128 mounted onto rack assemblies 122, 126, respectively.

Although the guide rails 120 and the rollers 128 are illustrated herein as facilitating movement of the respective rack assemblies 122, 126, it should be appreciated that any suitable sliding mechanism or member may be used according to alternative embodiments.

In optional embodiments, some or all of the rack assemblies 122, 126 are fabricated into lattice structures including a plurality of wires or elongated members 130 (for clarity of illustration, not all elongated members making up rack assemblies 122, 126 are shown). In this regard, rack assemblies 122, 126 are generally configured for supporting articles within wash chamber 106 while allowing a flow of wash liquid to reach and impinge on those articles (e.g., during a cleaning or rinsing phase of the wash cycle). According to additional or alternative embodiments, a silverware basket (not shown) may be removably attached to a rack assembly (e.g., lower rack assembly 122), for placement of silverware, utensils, and the like, that are otherwise too small to be accommodated by the rack assembly.

Generally, the dishwashing appliance 100 includes one or more spray assemblies for urging a flow of fluid (e.g., wash liquid) onto the articles placed within the wash chamber 106. In exemplary embodiments, the dishwashing appliance 100 includes a lower spray arm assembly 134 disposed in a lower region 136 of the wash chamber 106 and above a sump 138 so as to rotate in relatively close proximity to lower rack assembly 122. In this regard, the lower spray arm assembly 134 may generally be configured for urging a flow of wash liquid up through the lower rack assembly 122.

In some embodiments, an upper spray assembly 142 is located proximate to and, e.g., below, upper rack assembly 126 along the vertical direction V. In this manner, the upper spray assembly 142 may be generally configured for urging of wash liquid up through the upper rack assembly 126.

The various spray assemblies and manifolds described herein may be part of a fluid distribution system or fluid circulation assembly 150 for circulating wash liquid in the tub 104. In certain embodiments, the fluid circulation assembly 150 includes a circulation pump 152 for circulating wash liquid in tub 104. The circulation pump 152 may be mounted to the sump 138 and in fluid communication with the sump 138 through a circulation outlet 151 from the sump 138.

When assembled, the circulation pump 152 may be in fluid communication with an external water supply line (not shown) and the sump 138. A water inlet valve (not shown) can be positioned between the external water supply line and the circulation pump 152 (e.g., to selectively allow water to flow from the external water supply line to the circulation pump 152). Additionally or alternatively, the water inlet valve can be positioned between the external water supply line and the sump 138 (e.g., to selectively allow water to flow from the external water supply line to sump 138). During use, the water inlet valve may be selectively controlled to open to allow the flow of water into the dishwashing appliance 100 and may be selectively controlled to close and thereby cease the flow of water into the dishwashing appliance 100. Further, the fluid circulation assembly 150 may include one or more fluid conduits or circulation piping for directing wash fluid from the circulation pump 152 to the various spray assemblies and manifolds. In an embodiment, such as that shown in FIG. 3, a primary supply conduit 154 extends from the circulation pump 152, along the rear side 112 of the tub 104 along the vertical direction V to supply wash liquid throughout the wash chamber 106.

In an embodiment, the circulation pump 152 urges or pumps wash liquid to a diverter 156 (FIG. 3). In some such embodiments, the diverter 156 is positioned within sump 138 of the dishwashing appliance 100). The diverter 156 may include a diverter disk (not shown) disposed within a diverter chamber 158 for selectively distributing the wash liquid to the spray assemblies 134, 142, or other spray manifolds or assemblies. For instance, the diverter disk may have at least one aperture configured to align with one or more outlet ports (not shown) at the top of diverter chamber 158. In this manner, the diverter disk may be selectively rotated to provide wash liquid to the desired spray device(s).

In an embodiment, the diverter 156 is configured for selectively distributing the flow of wash liquid from the circulation pump 152 to various fluid supply conduits (only some of which are illustrated in FIG. 3 for clarity). In certain embodiments, the diverter 156 includes two or more outlet ports (not shown) for supplying wash liquid to a first conduit for rotating the lower spray arm assembly 134 and a second conduit for supplying the upper spray assembly 142 (e.g., supply conduit 154). Additional embodiments may also include one or more additional conduits, e.g., a third conduit for spraying an auxiliary rack such as a silverware rack, etc.

In some embodiments, a supply conduit 154 is used to supply wash liquid to one or more spray assemblies (e.g., to upper spray assembly 142). It should be appreciated, however, that according to alternative embodiments, any other suitable plumbing configuration may be used to supply wash liquid throughout the various spray manifolds and assemblies described herein. For instance, according to another embodiment, the supply conduit 154 could be used to provide wash liquid to the lower spray arm assembly 134 and a dedicated secondary supply conduit (not shown) could be utilized to provide wash liquid to the upper spray assembly 142. Other plumbing configurations may be used for providing wash liquid to the various spray devices and manifolds at any location within the dishwashing appliance 100.

Each spray assembly 134 and 142, or other spray device as may be included in the dishwashing appliance 100, may include an arrangement of discharge ports or orifices for directing wash liquid received from the circulation pump 152 onto dishes or other articles located in the wash chamber 106. The arrangement of the discharge ports, also referred to as jets, apertures, or orifices, may provide a rotational force by virtue of wash liquid flowing through the discharge ports. Alternatively, the spray assemblies 134, 142 may be motor-driven, or may operate using any other suitable drive mechanism. Spray manifolds and assemblies may also be stationary. The resultant movement of the spray assemblies 134, 142 and the spray from fixed manifolds provides coverage of dishes and other dishwasher contents with a washing spray. Other configurations of spray assemblies may be used as well. For instance, the dishwashing appliance 100 may have additional spray assemblies for cleaning silverware, for scouring casserole dishes, for spraying pots and pans, for cleaning bottles, etc.

Drainage of soiled wash liquid within the sump 138 may be provided, for instance, by a drain pump 168 (e.g., during or as part of a drain phase). In particular, wash liquid may exit the sump 138 through a drain outlet 167 and may flow through a drain conduit or directly to the drain pump 168. Thus, the drain pump 168 is downstream of the sump 138 and facilitates drainage of the soiled wash liquid by urging or pumping the wash liquid to a drain line external to dishwashing appliance 100.

Figure 4:
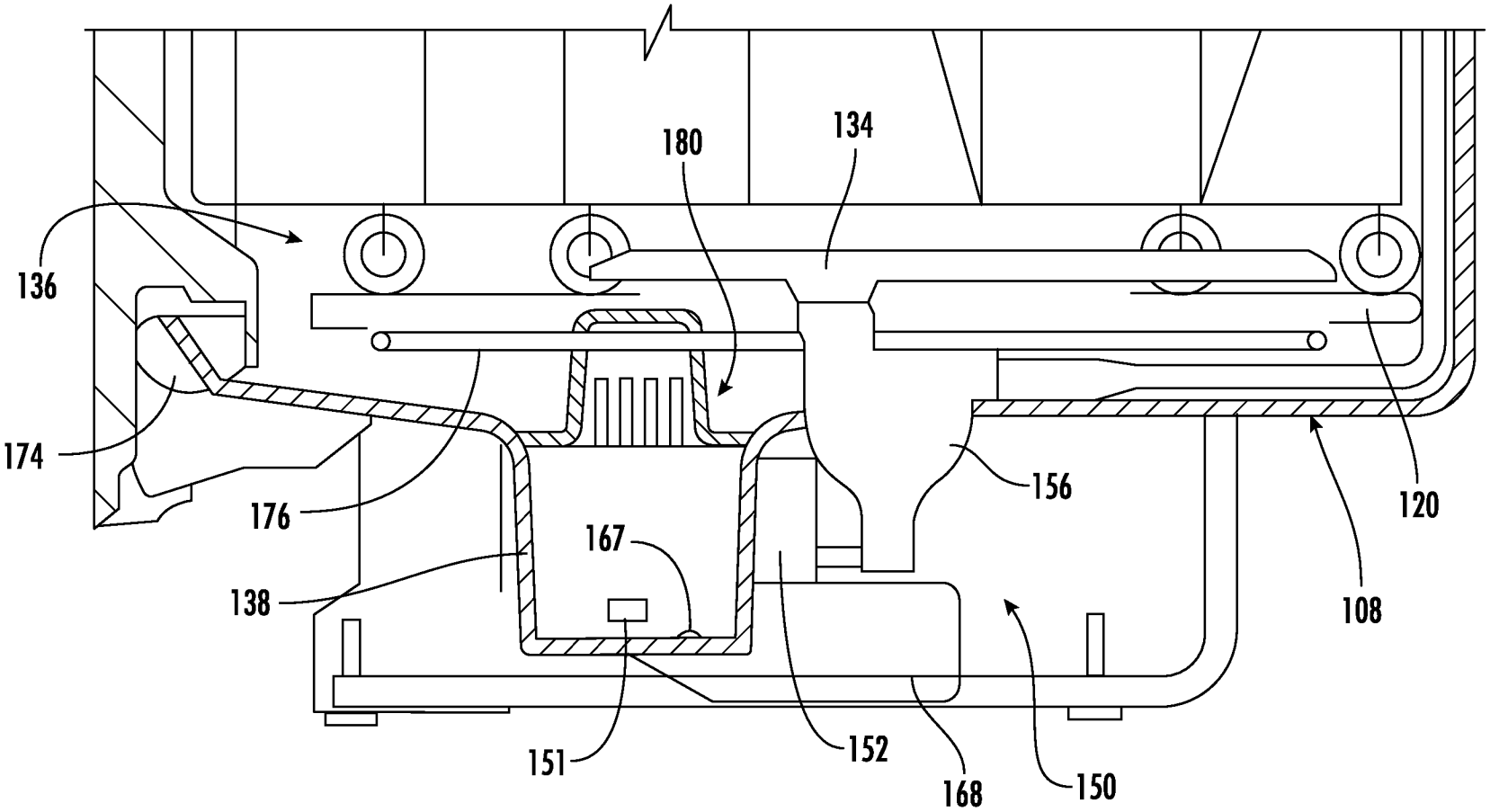
FIG. 4 provides an enlarged view of a portion of the exemplary dishwashing appliance of FIG. 3.

In some embodiments, as shown in FIGS. 3 and 4, a filter assembly 180 may be provided, e.g., in the sump 138 and/or at a top entrance into the sump 138, e.g., to filter fluid to the circulation assembly 150 and/or the drain pump 168. Generally, the filter assembly 180 removes soiled particles from the liquid that flows to the sump 138 from the wash chamber 106 during operation of the dishwashing appliance 100. In an embodiment, the filter assembly 180 may include a filter basket having a first filter (also referred to as a "coarse filter") and a second filter (also referred to as a "fine filter").

Although a separate circulation pump 152 and drain pump 168 are described herein, it is understood that other suitable pump configurations (e.g., using only a single pump for both recirculation and draining) may be provided.

The dishwashing appliance 100 may further include a heating element 176, such as a resistance heating element, positioned in or near the sump 138. For example, the heating element 176 may be positioned "near" the sump 138 in that the heating element 176 is disposed above the sump 138 and within the lower region 136 of the wash chamber 106, such as below the lower spray arm 134 and/or below the lower rack assembly 122. The heating element 176 may be positioned and configured to heat liquid in the sump 138, such as for a heated wash phase, and/or to heat air within the wash chamber 106, such as for drying articles during a dry phase.

The dishwashing appliance 100 may also include ventilation features, e.g., to promote improved, e.g., more rapid, drying of articles therein after the wash and rinse phases. For example, one or more vents 166 may be provided in the tub 104 for introducing relatively dry air from outside of the tub 104 into the wash chamber 106 and/or for removing relatively humid air from the wash chamber 106 to the outside of the tub 104. In some embodiments, a fan 172 may be provided. The fan 172 may be operable to urge air through the wash chamber 106, such as to promote air circulation and/or ventilation within and through the wash chamber. Such air movement may increase the rate of evaporation of moisture from articles in the wash chamber 106 after a wash and/or rinse phase.

In certain embodiments, the dishwashing appliance 100 includes a controller 160 configured to regulate operation of dishwashing appliance 100 (e.g., initiate one or more wash operations). The controller 160 may include one or more memory devices and one or more microprocessors, such as general or special purpose microprocessors operable to execute programming instructions or micro-control code associated with a wash operation or wash cycle that may include a pre-wash phase, a wash phase, a rinse phase, a drain phase, and/or a dry phase. The memory may represent random access memory such as DRAM or read only memory such as ROM or FLASH. In some embodiments, the processor executes programming instructions stored in memory. The memory may be a separate component from the processor or may be included onboard within the processor. Alternatively, the controller 160 may be constructed without using a microprocessor, e.g., using a combination of discrete analog or digital logic circuitry to perform control functionality instead of relying upon software. It should be noted that controllers as disclosed herein are capable of and may be operable to perform any methods and associated method steps as disclosed herein.

The controller 160 may be positioned in a variety of locations throughout dishwashing appliance 100. In an embodiment, the controller 160 is located within a control panel area 162 of door 116 (FIG. 1). Input/output ("I/O") signals may be routed between the control system and various operational components of the dishwashing appliance 100 along wiring harnesses that may be routed through the bottom of door 116. Typically, the controller 160 includes or is operatively coupled to a user interface panel 164 through which a user may select various operational features and modes and monitor progress of the dishwashing appliance 100. In some embodiments, user interface panel 164 includes a general purpose I/O ("GPIO") device or functional block.

In an embodiment, the user interface panel 164 includes input components, such as one or more of a variety of electrical, mechanical or electro-mechanical input devices including rotary dials and/or push buttons. In further embodiments, user interface panel 164 includes a display component, such as a digital or analog display device designed to provide operational feedback to a user. When assembled, the user interface panel 164 may be in operative communication with the controller 160 via one or more signal lines or shared communication busses.

It should be appreciated that the present disclosure is not limited to any particular style, model, or configuration of dishwashing appliance 100. The embodiments depicted in FIGS. 1 through 4 are for illustrative purposes only. For instance, different locations may be provided for the control panel area 162 (e.g., on the front of the door 116 as illustrated in FIG. 1 or on the top of the door 116 as illustrated in FIG. 2, or other locations as well), different configurations may be provided for rack assemblies 122, 126, different spray assemblies 134, 142 and spray manifold configurations may be used, different sensors may be used, and other differences may be applied while remaining within the scope of the present disclosure.

Referring generally to FIGS. 5-9, the present disclosure is directed to a design solution to provide easy leveling of an appliance, such as the dishwashing appliance 100. In particular, a component within the dishwashing appliance 100, such as the filter assembly 180, is designed to allow the installer of the dishwashing appliance 100 to view the level status of the unit at any desired time, without the use of any other tools. In an embodiment, for example, the dishwashing appliance 100 includes a level of some type integrated into a component that is installed on the dishwashing appliance 100 at the time of assembly at the factory. More specifically, in an embodiment, the component may include the filter assembly 180, which can be formed with a recess molded into the filter to receive a bubble level. In an embodiment, for example, the bubble level can be adhered or snapped into place to become part of the filter assembly 180. Further, the filter assembly 180 may be a centrally located component that can be easily viewed by the user when needed. For example, easy viewing of the component allows the installer to consciously monitor the unit for levelness when cleaning and re-installing the filter assembly 180.

Figure 5:
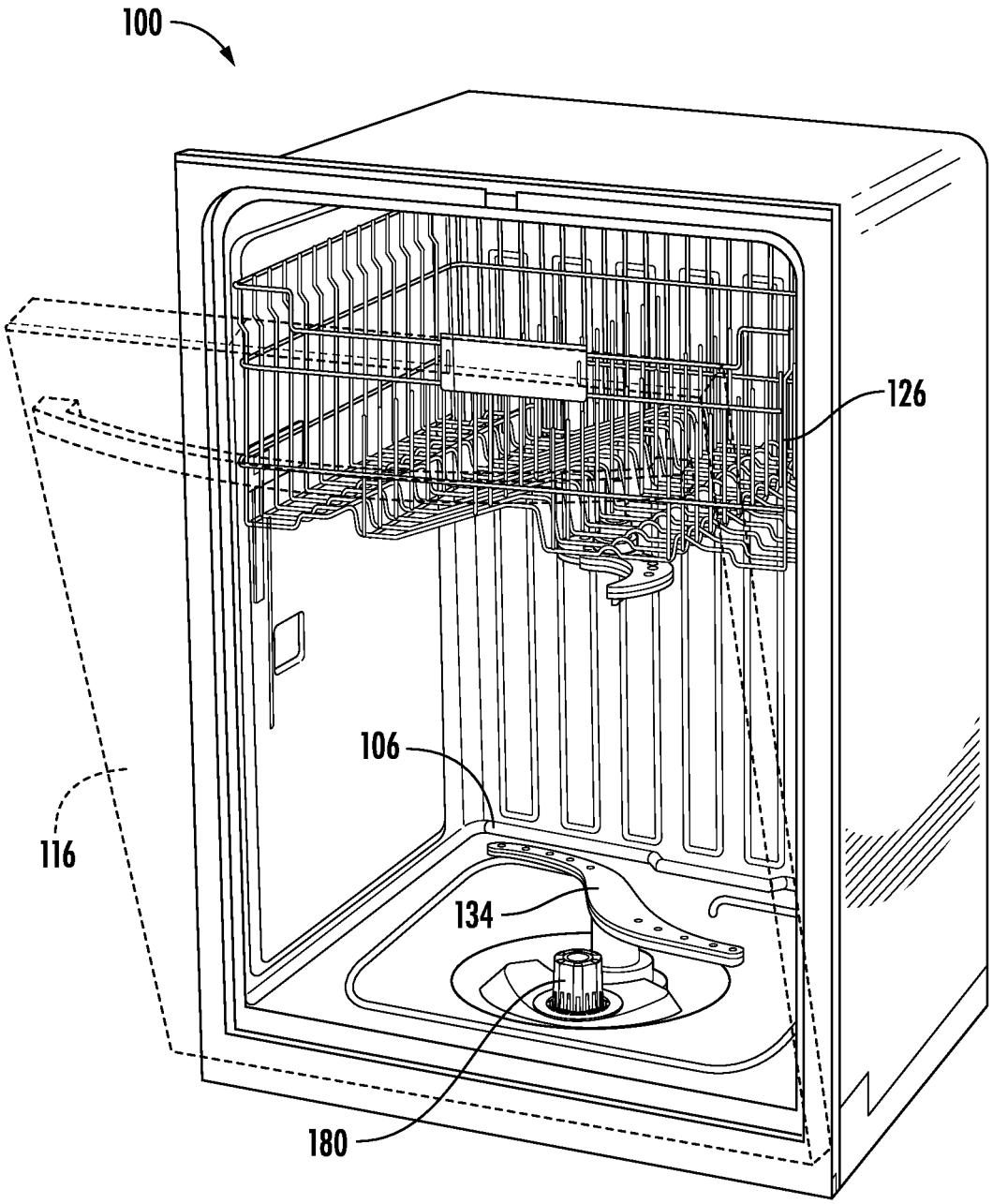
FIG. 5 illustrates a front, perspective view of an embodiment of the dishwashing appliance with the filter assembly secured in the wash chamber thereof according to the present disclosure, particularly illustrating a door of the dishwashing appliance in an open position.
Figure 6:
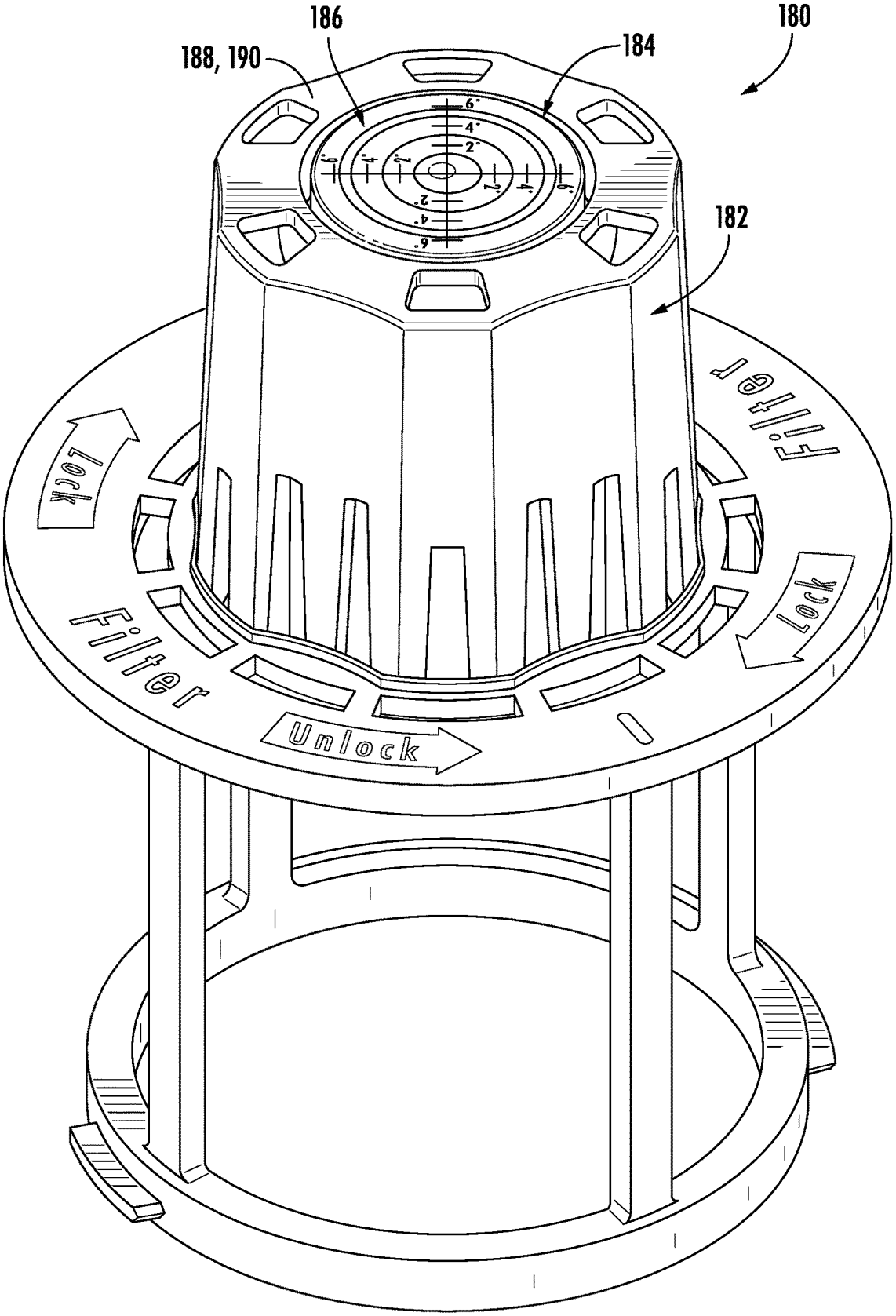
FIG. 6 illustrates a perspective view of an embodiment of the filter assembly 180 of the dishwashing appliance 100 having a bubble level arranged in a recess 184 thereof according to the present disclosure.
Figure 7:
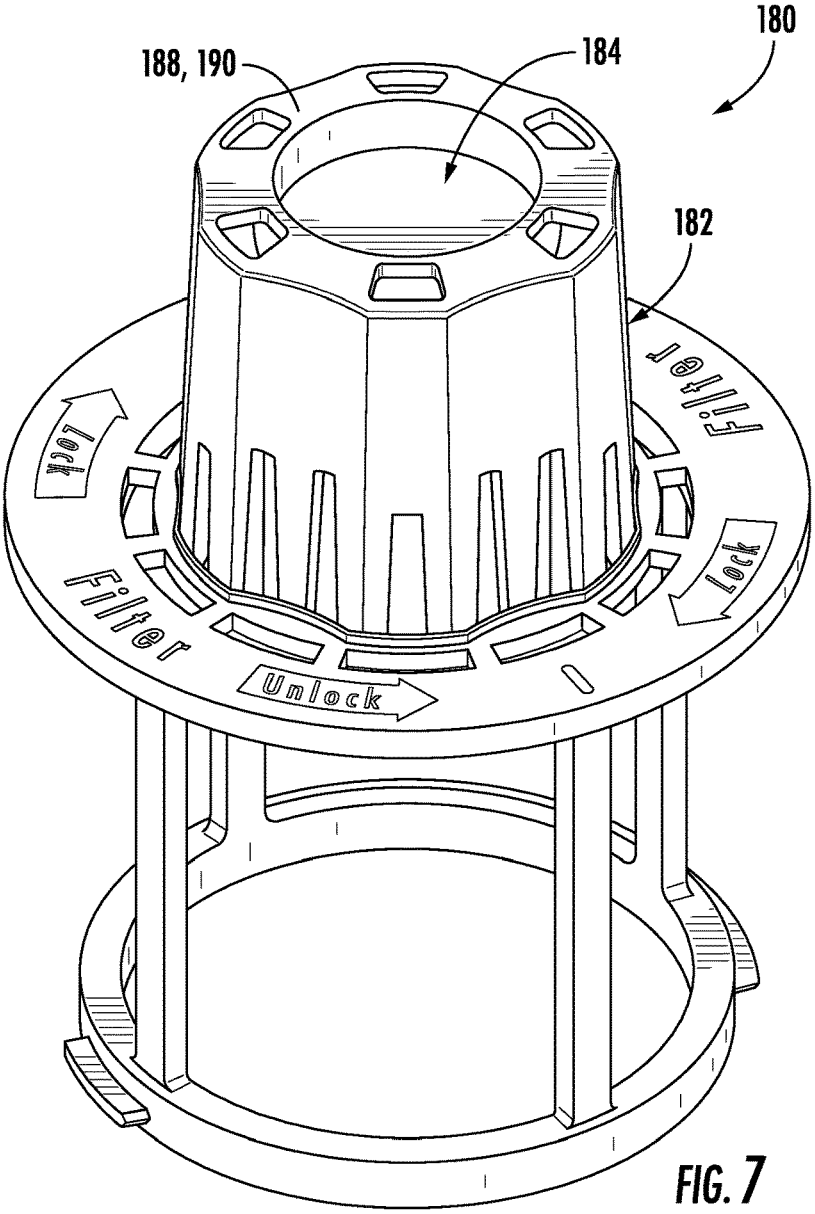
FIG. 7 illustrates a perspective view of an embodiment of the filter assembly of the dishwashing appliance having the recess according to the present disclosure.
Figure 8:
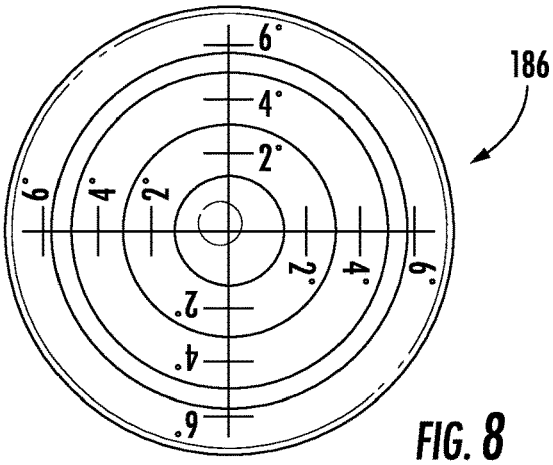
FIG. 8 illustrates a top view of an embodiment of the bubble level according to the present disclosure.

Referring now to FIGS. 5-8, various views of an embodiment of a component, such as the filter assembly 180 of the dishwashing appliance 100 having a bubble level 186 according to the present disclosure are illustrated. In particular, FIG. 5 illustrates a front, perspective view of an embodiment of the dishwashing appliance 100 with the filter assembly 180 secured in the wash chamber 106 thereof according to the present disclosure. FIG. 6 illustrates a perspective view of an embodiment of the filter assembly 180 of the dishwashing appliance 100 having a bubble level 186 arranged in a recess 184 thereof according to the present disclosure. FIG. 7 illustrates a perspective view of an embodiment of the filter assembly 180 of the dishwashing appliance 100 having the recess 184 according to the present disclosure. FIG. 8 illustrates a top view of an embodiment of the bubble level 186 according to the present disclosure.

In particular, as shown in FIGS. 6 and 7, the filter assembly 180 includes a filter body 182 for filtering coarse and fine particulates. Further, as shown, the filter body 182 has a recess 184 formed into an exterior surface 188 thereof. More specifically, in an embodiment, the recess 184 may be an arcuate recess formed into a top surface 190 of the filter body 182. Moreover, as shown, the filter assembly 180 includes a bubble level 186 positioned in the recess 184. More specifically, as shown, the bubble level 186 is a bull's eye bubble level positioned in the arcuate recess. In another embodiment, the recess 184 may be a linear recess and the bubble level 186 may be a tubular bubble level positioned in the linear recess. Furthermore, in an embodiment, the bubble level 186 may be secured within the recess 184 via an adhesive.

Accordingly, when the filter assembly 180 is installed in the dishwashing appliance 100 (see e.g., FIGS. 3-5), the bubble level 186 is viewable from outside of the wash chamber 106 when the door 116 is in the open position (FIG. 5). In addition, as shown in FIG. 5, the filter assembly 180 is secured in a central position within the wash chamber 106. It should be understood that the filter assembly 180 is not required to be positioned in a central position of the wash chamber 106 but may be in any suitable location such that a user can easily view the bubble level 186 when installing the dishwashing appliance 100.

Figure 9:
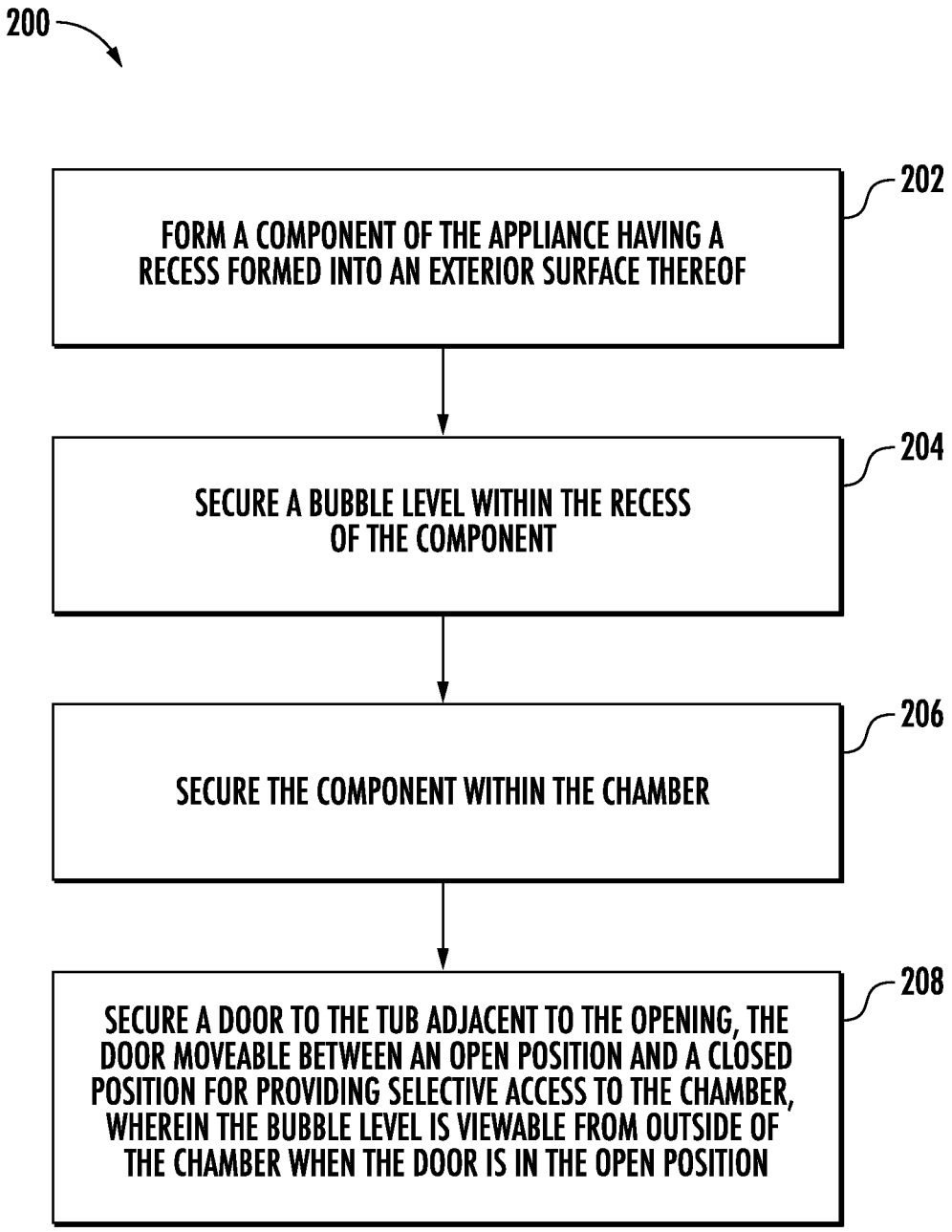
FIG. 9 illustrates a flow diagram of an embodiment of a method of manufacturing an appliance having a tub that defines a chamber having an opening according to the present disclosure.

Referring now to FIG. 9, embodiments of the present disclosure may also include methods of manufacturing an appliance having a tub that defines a chamber having an opening, such as the exemplary method 200 illustrated in FIG. 9. For example, such methods may be used with the dishwashing appliance 100 and the filter assembly 180 but are not limited to this particular dishwashing appliance and filter assembly. Accordingly, it is to be understood that reference numerals for the dishwashing appliance 100 and components thereof are included in the description of the method 200 solely for purposes of illustration and by way of example only.

As shown at (202), the method 200 includes forming a component of the appliance having a recess formed into an exterior surface thereof. For example, in an embodiment, the component may be a filter of the dishwasher appliance. Thus, in such embodiments, the method 200 may include forming an arcuate recess into a top surface of the filter. Further, in an embodiment, the component may be formed via any other suitable molding process, such as injection molding, compression molding, or similar.

As shown at (204), the method 200 includes securing a bubble level within the recess of the component. For example, in an embodiment, the bubble level may be secured within the recess via an adhesive. As shown at (206), the method 200 includes securing the component within the chamber. For example, in an embodiment, the method 200 may include securing the component in a central position within the chamber. As shown at (208), the method 200 includes securing a door to the tub adjacent to the opening, the door moveable between an open position and a closed position for providing selective access to the chamber, wherein the bubble level is viewable from outside of the chamber when the door is in the open position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, comprising:

a tub that defines a chamber having an opening;

a door secured to the tub adjacent to the opening, the door moveable between an open position and a closed position for providing selective access to the chamber;

a component secured within the chamber; and a bubble level integrated with the component, wherein the bubble level is viewable from outside of the chamber when the door is in the open position.

2. The appliance of claim 1, wherein the component is secured in a central position within the chamber.

3. The appliance of claim 1, wherein the component has a recess formed into an exterior surface thereof, the bubble level being positioned within the recess of the component.

4. The appliance of claim 3, wherein the appliance is a dishwashing appliance.

5. The appliance of claim 4, wherein the component is a filter of the dishwashing appliance.

6. The appliance of claim 5, wherein the recess is an arcuate recess formed into a top surface of the filter.

7. The appliance of claim 1, wherein the bubble level comprises one of a bull's eye bubble level or a tubular bubble level.

8. The appliance of claim 1, wherein the bubble level is secured within the recess via an adhesive.

9. A dishwashing appliance, comprising:

a tub that defines a wash chamber having a front opening;

a door secured to the tub adjacent to the front opening, the door moveable between an open position and a closed position for providing selective access to the wash chamber;

a filter secured within the wash chamber, the filter having a recess formed into an exterior surface thereof, and a bubble level positioned in the recess of the filter, wherein the bubble level is viewable from outside of the chamber when the door is in the open position.

10. The dishwashing appliance of claim 9, wherein the filter is secured in a central position within the wash chamber.

11. The dishwashing appliance of claim 9, wherein the recess is an arcuate recess formed into a top surface of the filter.

12. The dishwashing appliance of claim 11, wherein the bubble level is a bull's eye bubble level positioned in the arcuate recess.

13. The dishwashing appliance of claim 9, wherein the bubble level is secured within the recess via an adhesive.

14. A method of manufacturing an appliance having a tub that defines a chamber having an opening, the method comprising:

forming a component of the appliance having a recess formed into an exterior surface thereof;

securing a bubble level within the recess of the component;

securing the component within the chamber; and securing a door to the tub adjacent to the opening, the door moveable between an open position and a closed position for providing selective access to the chamber, wherein the bubble level is viewable from outside of the chamber when the door is in the open position.

15. The method of claim 14, wherein forming the component of the appliance having the recess formed into the exterior surface thereof further comprising forming the component via a molding process.

16. The method of claim 14, further comprising securing the component in a central position within the chamber.

17. The method of claim 14, wherein the appliance is a dishwashing appliance.

18. The method of claim 17, wherein the component is a filter of the dishwashing appliance.

19. The method of claim 18, wherein forming the component of the appliance having the recess formed into the exterior surface thereof further comprises forming an arcuate recess into a top surface of the filter.

20. The method of claim 14, further comprising securing the bubble level within the recess via an adhesive.

* * * * *